United States Patent [19]

Hrabal

[11] Patent Number: 4,869,291

[45] Date of Patent: Sep. 26, 1989

[54] COMPRESSOR PLATE VALVE

[75] Inventor: Hans Hrabal, Vienna, Austria

[73] Assignee: Hoerbiger Ventilwerke Aktiengesellschaft, Vienna, Austria

[21] Appl. No.: 262,741

[22] Filed: Oct. 26, 1988

[30] Foreign Application Priority Data

Oct. 28, 1987 [AT] Austria ..... 2843/87

[51] Int. Cl.[4] ..... F16K 15/18

[52] U.S. Cl. ..... 137/516.21; 417/296; 417/297

[58] Field of Search ..... 137/512.1, 512.15, 516.21; 417/296, 297, 270

[56] References Cited

U.S. PATENT DOCUMENTS

| | | | |
|---|---|---|---|
| 1,475,826 | 11/1923 | Hoffman | 137/512.1 X |
| 1,479,395 | 1/1924 | Metzgar | 137/512.15 X |
| 1,653,110 | 12/1927 | LeValley | 417/296 X |
| 1,769,899 | 7/1930 | Mathews | 137/512.1 |
| 3,829,253 | 8/1974 | Bunn et al. | 137/512.1 X |
| 4,632,145 | 12/1986 | Machu | 137/516.21 |
| 4,730,987 | 3/1988 | Kawai et al. | 417/270 |

FOREIGN PATENT DOCUMENTS

| | | | |
|---|---|---|---|
| 688429 | 2/1940 | Fed. Rep. of Germany | 417/297 |
| 2615627 | 10/1976 | Fed. Rep. of Germany | 417/297 |

*Primary Examiner*—John Rivell

*Attorney, Agent, or Firm*—Watson, Cole, Grindle & Watson

[57] ABSTRACT

A compressor plate valve has a valve seat, a valve guard and at least one valve plate which is mobile to-and-fro therebetween to control passage channels provided in the valve seat. To enable the compressor to be switched to idle running, a lifting device is provided for keeping the valve open. This comprises a seating plate which is disposed mobile between the valve seat and the valve plate in the direction of the lifting movement and has valve ports aligned with the passage channels in the valve seat and connection apertures corresponding with the passage apertures in the valve plate. The lifting force is applied to the seating plate by means of a control device.

10 Claims, 3 Drawing Sheets

Fig. 1
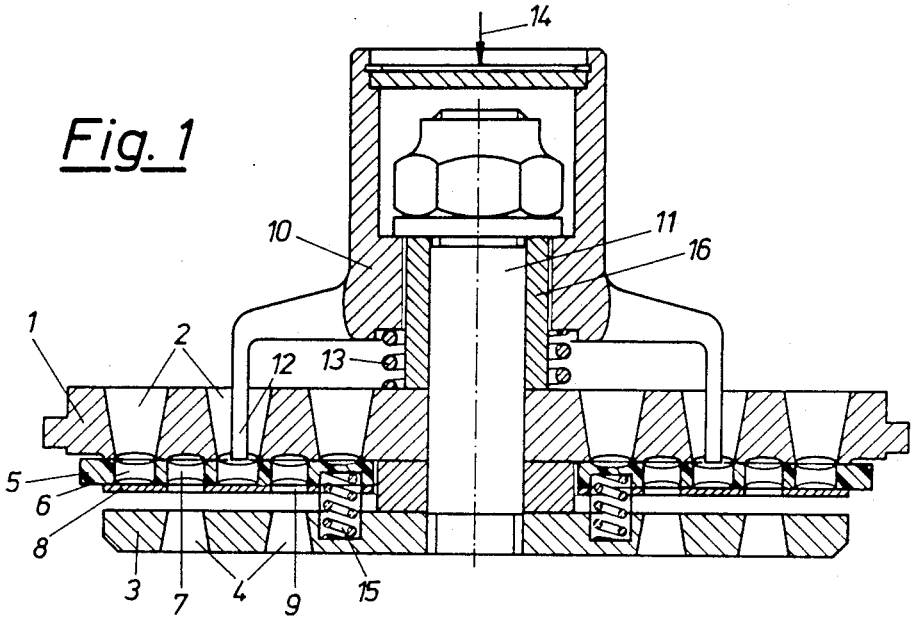
Fig. 2
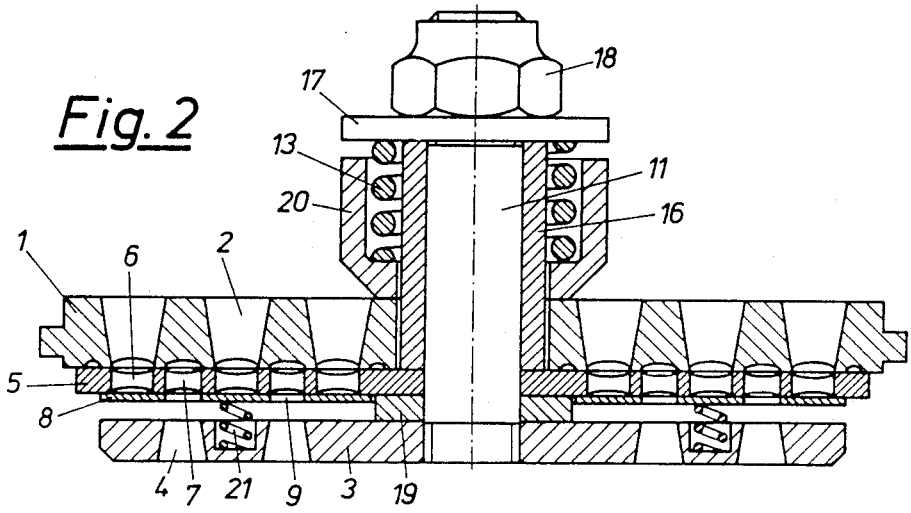
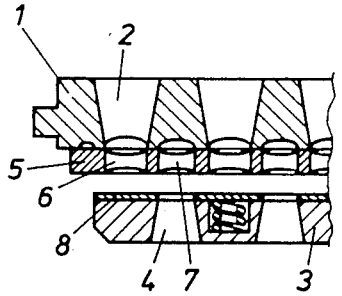
Fig. 3

Fig. 4
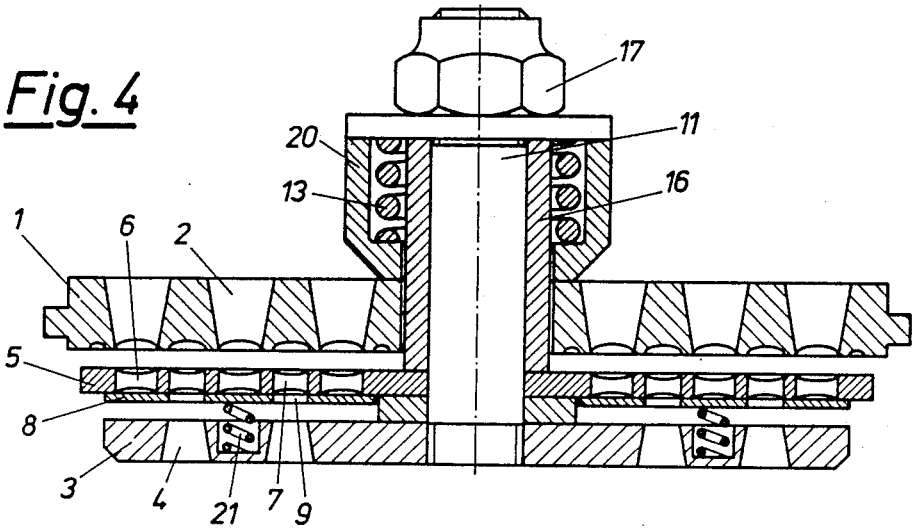
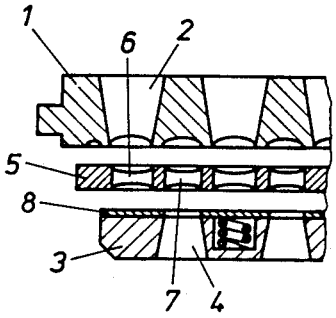
Fig. 5
Fig. 6
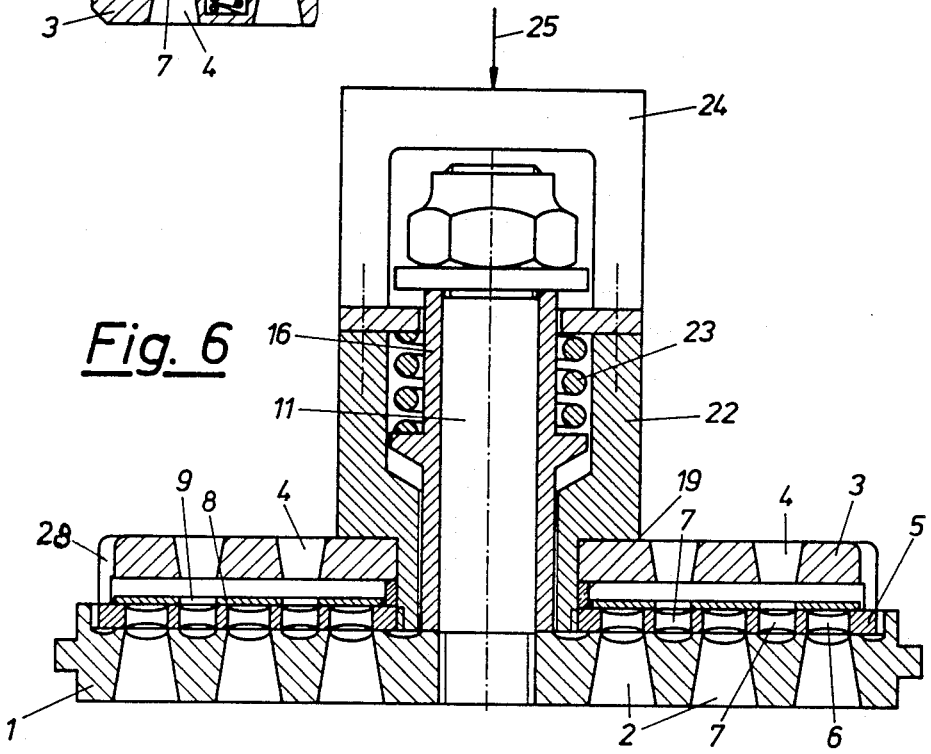

COMPRESSOR PLATE VALVE

SUMMARY OF THE INVENTION

The invention relates to a compressor plate valve comprising a valve seat, a valve guard and at least one valve plate which is mobile to-and-fro therebetween to control passage channels provided in the valve seat, and with which a lifting device is associated for keeping the valve open against the closure force acting on the valve plate.

Plate valves of this type comprising a lifting device are known in various forms. Their purpose is to enable the valve to be held open against the closure force acting on the valve plate, to thus control the throughput or to switch the compressor to idle running. In known forms the lifting device consists of a lifting gripper which by means of lifting fingers acts on the valve plate through the passage channels of the valve seat and is controlled by a control device. The lifting gripper, the lifting fingers of which are located in the flow channels for the flowing medium, reduces the free passage cross-section of the valve seat, this being a drawback when the compressor is running at full throughput. In addition, the valve plate is further mechanically stressed by the gripper, the fingers of which act on the valve plate only at points spaced apart from each other. It is therefore mostly necessary to make the valve plate thicker than in the case of unregulated valves in order to prevent deformation due to the often large closure forces which arise by virtue of the back-flow of the medium.

There are also lifting systems known in which the valve plate projects radially beyond the valve seat and is gripped below by protuberances projecting radially inwardly from a lifting ring.

This lifting ring is operated by a control device, including known systems which act on the lifting ring with a lifting gripper. In this construction the control device and lifting gripper can be provided radially outwardly of the valve seat and the passage channels so that they do not reduce the passage cross-section. However, they occupy additional space around the valve which could otherwise be used for further passage channels. In addition, in this construction the valve plate must again be stiffened and made mechanically rigid because the total lifting force acts only on its edge.

The object of the invention is to improve known plate valves comprising a lifting device in such a manner that the mechanical stressing of the valve plate due to its lifting and to the valve being forcibly maintained open is not disadvantageously greater than in the case of unregulated valves.

This object is attained according to the invention in that the lifting device comprises a separate seating plate which is disposed mobile between the valve seat and the valve plate in the direction of the lifting movements and comprises valve ports aligned with the passage channels in the valve seat and connection apertures corresponding with the passage apertures in the valve plate, and of a control device which acts on the seating plate and is operatively linked thereto at least in one direction of movement, in order to transmit the lifting force to the seat plate. Thus in the embodiment according to the invention, for lifting the valve plate a single seating plate is used by means of which the valve plate is supported over its entire surface during lifting. The control device no longer acts directly on the valve plate but instead transmits the lifting force thereto by way of the seating plate. The seating plate, which undergoes no movement in rhythm with the compressor cycle, lies at rest against the valve seat at full compressor throughput. It can therefore be made correspondingly thick and mechanically rigid without impairing the operational characteristics of the valve. As it is completely supported, the valve plate can be of thin and light construction even for automatic control, this being operationally advantageous. The lifting device according to the invention is particularly suitable or plate valves with a plastics valve plate.

In a simple embodiment of the plate valve according to the invention, the control device comprises a known lifting gripper the gripping fingers of which act on the seating plate. Although the gripping fingers are again disposed in the passage channels of the valve seat in this embodiment, they act on the valve plate not directly but by way of the seating plate, and thus fewer fingers are required so that the reduction in the passage cross-section of the passage channels is limited.

According to a further embodiment of the invention the control device comprises at least one screw bolt which is disposed preferably along the valve axis and guided to move axially in the valve seat, against the force of a return spring if provided, and act on the seating plate. In this way no lifting gripper is required. To transmit the necessary control movements, the central intermediate screw provided in many valve constructions can be used.

According to a further embodiment of the invention, the passage channels in the valve seat are again empty, wherein according to the invention the control device comprises a guide sleeve which is guided in an axially mobile manner, against the force of a lifting spring if provided, on a bolt connected to the valve seat, and is arranged to move the seating plate in at least one direction.

The seating plate can be fixed rigidly to the valve guard in such a manner that an intermediate space is left free for the lifting movements of the valve plate and be adjustable together with the valve guard in the lifting direction. With this embodiment, when the valve plate rises, it is not pressed against the valve guard but is retracted together with the seating plate a certain distance from the valve seat, so that the controlled medium can flow freely through the passage apertures disposed in the seating plate additionally to the valve ports. If the flow direction is from the valve seat to the valve guard, the valve plate can also be raised from the seating plate, to expose an additional flow cross-section in the seating plate.

If the control device comprises a screw bolt, according to the invention the seating plate and the valve guard can be fixed to the bolt. In the case of a control device with a guide sleeve, the seating plate and the valve guard can be fixed to the guide sleeve.

According to a further embodoiment of the invention the valve plate and any other plates provided in the valve can be centered on the seating plate and if necessary be guided so that they do not rub. In this manner all valve parts which move during valve operation and could possibly undergo wear are concentrated on the seating plate. This means that valve maintenance is simplified because only the seating plate and the components fixed to it need be repaired and if necessary replaced. In the case of the valve seat itself, only the shutoff surface which lies against the seating plate needs to be re-machined, and this only at long intervals.

To center the valve plate and any other plates on the seating plate, a known guide ring can be disposed at the center of the valve. The mobile plates are slidingly guided along this ring. Alternatively, in order to guide the valve plate and any other plates so that they do not rub, flexible linkages extending from the valve plate in known manner can be fixed to the seating plate. In both cases the seating plate forms with the associated valve plate a combined assembly which can be mounted in and removed from the valve as one unit.

In a preferred embodiment of the invention the seating plate is constructed of a material with good sealing properties such as plastics. This construction not only ensures reliable sealing between the valve plate and seating plate but also simplifies the seal between the valve seat and seating plate. Moreover, the seat plate is relatively simple to manufacture of plastics. It also reduces the operating noise of the valve.

Further details and advantages of the invention will be apparent from the description of some embodiments thereof given hereinafter with reference to the drawings. In these:

FIG. 1 is an axial middle section through a first embodiment of the plate valve according to the invention;

FIG. 2 is an axial middle section through a modified embodiment;

FIG. 3 is a detail of the valve of FIG. 2 in another operating position;

FIG. 4 is an axial middle section through the valve of FIG. 2 in its open position;

FIG. 5 is a detail thereof in another operating position; and

FIGS. 6 and 7 are axial middle sections through two further embodiments of the invention.

Figure 7:
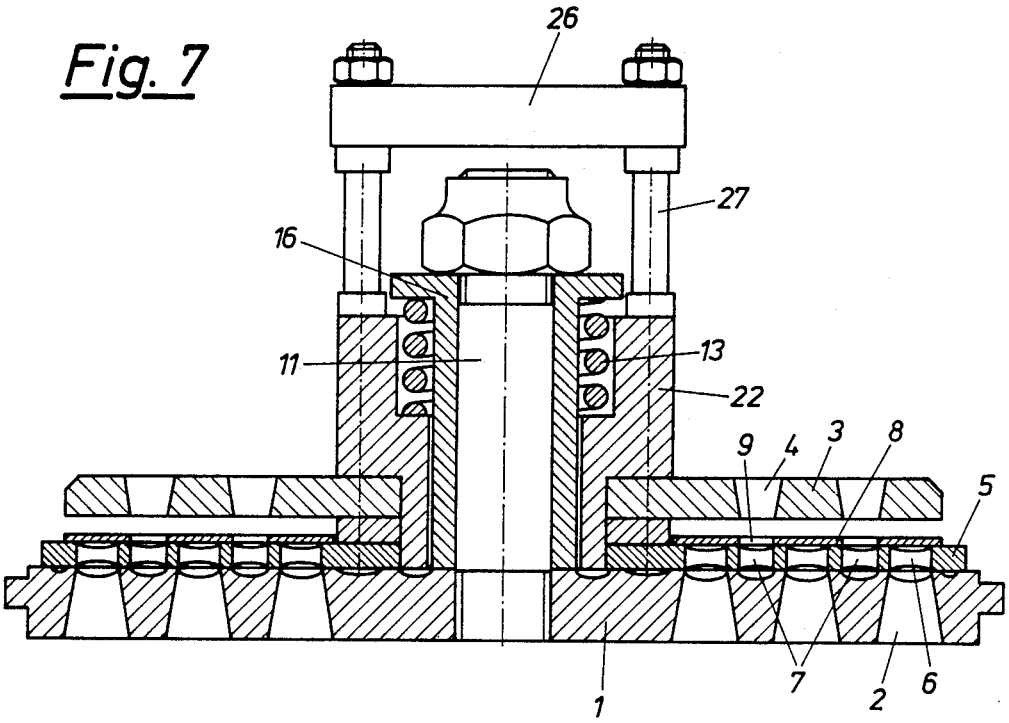

In all embodiments, the plate valve according to the invention comprises a valve seat 1 which has passage channels 2 for the medium delivered by the compressor, and with which a guard 3 having passage channels 4 is associated. A seating plate having valve ports 6 and connection apertures 7 lies directly against the valve seat 1. A valve plate 8 having passage openings 9 is disposed between the valve guard 3 and the seating plate 5. The valve ports 6 in the seating plate 5 are aligned with the passage channels 2 in the valve seat 1, whereas the connection apertures 7 are offset and correspond with the passage openings 9 in the valve plate 8 and with the passage channels 4 in the valve guard 3.

The seating plate 5 lies with one side tightly against the valve seat 1, and with its other side forms a sealing surface for the valve plate 8. The purpose of the seating plate 5 is to hold the valve open by acting against the valve plate 8 so as to cut off delivery from the compressor. For this purpose, to operate the seating plate a lifting device is provided comprising the afore described seating plate 5 and a control device acting on the seating plate to transmit the lifting force.

In the embodiment of FIG. 1, the control device comprises a lifting gripper 10 which is guided, in the direction of the lifting movement undergone by the valve plate 8, on a central screw bolt 11 disposed along the valve axis. The lifting gripper 10 acts by means of gripping fingers 12 on the seating plate 5 and is adjustable against the force of a return spring 13. The control force acts in the direction of the arrow indicated by 14 on the top of the lifting gripper 10. In the representation of FIG. 1, the gripper 10 is shown in its retracted end position under the action of the return spring 13. The gripper fingers 12, which are located on the seating plate 5 by way of radial connection bars, release the seating plate 5 which by means of springs 15 acting on it is tightly pressed against the valve seat 1. The medium which enters the valve through the passage channels 2 flows through the valve ports 6 in the seat plate 5, lifts the valve plate 8 from the seating plate 5 and pushes it against the valve guide 3. The medium can then leave the valve through the passage apertures 9 in the valve plate 8 and the through channels 4 in the valve guide 3. If the flow direction of the medium is reversed, the valve plate 8 is urged by the flow forces and displaced back against the seating plate 5 into the illustrated position, in which the valve is closed.

When a lifting force is applied to the lifting gripper 10 in the direction of the arrow 14 in order to cut off the delivery, the lifting fingers 12 come into contact with the seating plate 5 and lift it from the valve seat 1. The valve plate 8 is then moved with it and pressed against the valve guard 3. It can be seen from the drawing that the valve plate 8 is then supported practically over its entire surface by the solidly constructed seating plate 5, and is therefore subjected to practically no mechanical stressing during the lifting procedure. The valve plate 8 can therefore be of thin construction in spite of the controlled lifting. In addition, a valve plate of a material of mechanically poor rigidity such as plastics can be used. As the seating plate 5 is of sufficiently rigid and non-flexing construction, only a few gripping fingers 12 are required for lifting, so that the total finger assembly 12 does not cause disadvantageous narrowing of the passage channels 2 in the valve seat 1.

In the embodiment of FIG. 2, the central screw bolt 11 is used as the control device. The bolt 11 is supported in an axially slidable manner in a bore through the valve seat 1 by way of a sleeve 16. By means of a disc 17 on which the nut 18 of the bolt 11 acts, the sleeve 16 clamps the seating plate 5 via a lift spacer 19 against the valve guard 3, into which the bolt 11 is tightly screwed. The return spring 13 is disposed in a spring housing 20 and acts against the disc 17. The spring housing 20 also forms an end stop for the disc 17, by which the lifting movement is limited.

FIG. 2 shows the valve in its closed state with the lifting device inactive. The valve plate 8 is held against the sealing face of the seating plate 5 by the closure springs 21, so that the valve is closed. When flow arrives, the valve plate 8 is lifted from the seating plate 5 so that the medium, with the valve now open, can flow through it. As soon as the flow reverses its direction, the valve closes in known manner.

FIG. 4 shows the valve of FIG. 2 in the position which it assumes when forcibly held open by the lifting device. The lifting force is in this case appiled to the central screw bolt 11, which is displaced downwardly against the force of the return spring until the disc 17 rests against the upper edge of the spring housing 20. As can be seen from FIG. 4, in this position the seating plate 5 is lifted from the valve seat 1 so that the medium can flow in either direction through the valve. There is an open connection between the passage channels 2 of the valve seat 1 and the passage channels 4 of the valve guard 3, by way of the connection apertures 7 in the seating plate 5 and the through apertures 9 in the valve plate 8. The medium can thus flow in either direction through the valve. If the flow is in the direction from the valve seat to the guard 3, the valve plate 8 is additionally lifted from the seating plate 5 by the action of the flow forces, as can be seen in FIG. 5. By this means, an additional flow cross-section is provided in this direction. As soon as the lifting force is removed from the bolt 11, the valve returns under the action of the return spring 13 to the position shown in FIG. 3, in which it can perform its normal valve function.

It is well known that compressor suction valves are generally lifted to allow the compressor to be switched to idle running. FIGS. 6 and 7 show possible arrangements for controlling delivery valves. In FIG. 6 a guide sleeve 22 is disposed on the central bolt 11, on a bush 16 fixed thereon, and is slidable against the force of a lifting spring 23. The guide sleeve 22 is firmly fixed to the seating plate 5 and the valve guide 3. Lifting into the idle-running position is done by the force of the lifting spring 23. The guide sleeve 22 together with the valve parts connected thereto is moved back into its working position by way of a press bridge 24, during which a pressing force acting continuously in the direction of the arrow 25 holds the valve in its working position against the action of the lifting spring 23. The sealing pressure between the seating plate 5 and the valve seat 1 can also be adjusted by the pressing force in the direction of the arrow 25. The valve guard 3 is also provided on its outer edge with support webs 28 which additionally support the seating plate 5 and thus ensure that the seating plate 5 is flat and lies tightly over its entire surface against the valve seat 1. This can be an advantage in the case of large valves.

A guide sleeve 22 is also provided in the embodiment of FIG. 7 and is firmly fixed to the seating plate 5 and valve guard 3. In contrast to the embodiment of FIG. 6, in this case a return spring 13 acts on the guide sleeve 22 in the direction of the valve seat 1, so that the valve parts are urged into their working position when externally operating control forces are lacking. A draw plate 26 connected to the guide sleeve 22 by stay bolts 27 is provided for holding the valve open. Lifting is in this case done by a pulling force acting on the draw plate 26, by which the seating plate 5 together with the valve plate 8 and valve guard 3 are lifted from the valve seat 1 against the force of the return spring 13. The controlled medium can thus flow through the openly held valve in the same manner as shown in FIGS. 2 to 5.

From the illustrated and described embodiments it can be seen that with the lifting device provided in accordance with the invention the valve plate is supported when in its lifted position practically over its total surface by the lifting device, so that in practice it is hardly subjected to bending stress by the action of flow forces. The components and attachments necessary for the lifting lie substantially outside the passage path through the valve, so that the flow cross-section is not disadvantageously reduced.

What is claimed is

1. A compressor plate valve comprising, in combination, a valve seat having passage channels, a valve guard, and at least one valve plate having passage openings, said valve plate being disposed between said valve seat and said valve guard for axial movement therebetween to control said passage channels, a lifting device for holding the plate valve open against an axial closure force acting on said valve plate and for effecting a lifting movement of said valve plate, said lifting device comprising a separate seating plate disposed between said valve seat said valve plate for movement therebetween in directions of the lifting movement, said seating plate having valve ports aligned with said passage channels in said valve seat, and said seating plate further having connection apertures corresponding with said passage openings in said valve plate, and said lifting device further comprising a control device acting on said seating plate and being operatively linked thereto at least in one of said directions of movement for transmitting a lifting force to said seating plate.

2. The plate according to claim 1, wherein said control device comprises a lifting gripper having gripping fingers acting on said seating plate.

3. The plate according to claim 1, wherein said control device comprises at least one screw bolt disposed along a central axis of the valve for axial movement relative to said valve seat against the force of a return spring.

4. The plate according to claim 1, wherein said control device comprises a guide sleeve and a bolt fixed to said valve seat, said sleeve surrounding said bolt for relative axial movement against the force of a spring, and said sleeve being arranged for movement of said seating plate in at least one of the directions of the lifting movement.

5. The plate according to claim 3, wherein said seating plate is fixed to said valve guard for defining an intermediate space permitting said lifting movement, and said seating plate being adjustable together with said valve guard in said directions of movement.

6. The plate according to claim 3, wherein said seating plate and said valve guard are fixed to said bolt.

7. The plate according to claim 1, wherein said seating plate and said valve guard are fixed to said guide sleeve.

8. The plate according to claim 1, wherein said plate is centered relative to said seating plate.

9. The plate according to claim 8, wherein a central guide ring is provided for centering said valve plate relative to said seating plate.

10. The plate according to claim 1, wherein said seating plate is comprised of plastic material.

* * * * *